US008087107B2

(12) United States Patent
Le et al.

(10) Patent No.: US 8,087,107 B2
(45) Date of Patent: Jan. 3, 2012

(54) DUAL FLUSH VALVE REFILL

(75) Inventors: Tuan Le, Diamond Bar, CA (US); Bryan Janish, Carlsbad, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 799 days.

(21) Appl. No.: 12/172,070

(22) Filed: Jul. 11, 2008

(65) Prior Publication Data

US 2009/0019627 A1 Jan. 22, 2009

Related U.S. Application Data

(60) Provisional application No. 60/959,643, filed on Jul. 16, 2007.

(51) Int. Cl.
*E03D 1/00* (2006.01)

(52) U.S. Cl. ..... 4/415; 4/325; 137/441

(58) Field of Classification Search ..... 4/324, 325, 4/415; 137/441
See application file for complete search history.

(56) References Cited

U.S. PATENT DOCUMENTS

| | | | | |
|---|---|---|---|---|
| 4,497,076 | A * | 2/1985 | Sullivan | 4/392 |
| 5,594,959 | A * | 1/1997 | Nichols-Roy et al. | 4/415 |
| 6,385,788 | B1 * | 5/2002 | Wasielewski | 4/415 |
| 6,823,889 | B1 * | 11/2004 | Schuster | 137/441 |
| 7,010,816 | B2 | 3/2006 | Li | |
| 7,200,877 | B2 | 4/2007 | Peng | |
| 7,650,652 | B2 * | 1/2010 | Schuster et al. | 4/415 |
| 7,743,436 | B1 * | 6/2010 | Schuster et al. | 4/415 |

OTHER PUBLICATIONS

Notification of Transmittal of the International Search Authority, Written Opinion for International Application No. PCT/US08/69868 dated Oct. 22, 2008, 9 pages.

* cited by examiner

*Primary Examiner* — Gregory Huson
*Assistant Examiner* — Janie Christiansen
(74) *Attorney, Agent, or Firm* — Gordon & Rees LLP

(57) ABSTRACT

A dual flush valve is provided for refilling fluid in a toilet bowl. The dual flush valve includes a refill mechanism configured to refill the toilet bowl with a substantially same volume of refill fluid for both a full flush and a half flush, a first valve connected to the refill mechanism, the first valve operates to control flow of fluid into a bowl, a fluid input is connected to a first port of the first valve, and a fluid output is connected to a second port of the first valve. The level of fluid in the bowl is refilled to a same level for both a full flush and a half flush.

6 Claims, 6 Drawing Sheets

DUAL FLUSH VALVE REFILL

RELATED APPLICATIONS

This application relates to, claims priority from, and incorporates herein by reference, as if fully set forth, U.S. Provisional Patent Application Ser. No. 60/959,643, filed on Jul. 16, 2007 and entitled "DUAL FLUSH VALVE REFILL."

BACKGROUND

1. Field

The present embodiments relate generally to toilet flush valves and particularly to refill for dual flush valves.

2. Description of Prior Art and Related Information

A toilet tank typically employs a flush valve that is forced open, which remains open until a predetermined amount of water flows from the tank into the toilet bowl through the flush valve. A fill valve provides water from a supply line to the toilet tank. The fill valve is open whenever the water level in the tank is below a predetermined level.

In a dual flush valve toilet assembly, a toilet bowl is normally refilled during the time the toilet tank is filled up by water from a fill valve. The amount of water used to refill a toilet bowl must be enough to seal off the trap way of the howl. This amount usually is determined as a percentage of the total flow volume of a fill valve during a flush cycle. This water is tapped from a port of a fill valve and fed to the tank bowl through a flexible tube, running down an overflow tube of a flush valve. There are two scenarios when a dual flush is used in a toilet to flush water from the tank to the bowl.

First, the refill amount is set so that for a full flush, water is refilled just enough to seal off the trap way of the bowl. However, for a half flush, when it only takes about a half of the time to fill up the tank compared to a full flush, refilled water is not enough to seal off the trap way. This will create three problems for the bowl: dirty bowl for the next usage, sewage gas escaped from the trap way, and a bad flush on the next usage.

Second, the refill amount is set higher so that a half flush can have enough water to refill the bowl to seal off the trap way. However, for a full flush, because of its double filling time, more water will be wasted and the total flow volume for a full flush may not meet code requirements.

BRIEF SUMMARY

One aspect provides a dual flush valve is provided for refilling fluid in a toilet bowl. The dual flush valve includes a refill mechanism, a first valve connected to the refill mechanism, the first valve operates to control flow of fluid into a bowl, a fluid input is connected to a first port of the first valve, and a fluid output is connected to a second port of the first valve. The level of fluid in the bowl is refilled to a same level for both a full flush and a half flush.

In one embodiment the refill mechanism includes a float-weight cup. In another embodiment the first valve is controlled by a movable rail. In yet another embodiment the first valve is controlled by fluid level in a tank. In still another embodiment the float-weight cup opens and closes the first valve. In another embodiment the dual flush valve apparatus is disposed in a tank. In one embodiment the float-weight cup opens and closes the first valve based on fluid level in a tank. In one embodiment the first valve opens and closes by a float member based on fluid level in a tank. In yet another embodiment, upon the rail moving to a first vertical position the first valve substantially blocks fluid flow to the bowl, and upon the rail moving to a second vertical position the first valve allows fluid flow to the bowl. In still yet another embodiment, upon the first valve opening in a first direction, fluid flows from the first port of the first valve to the second port of the first valve and into an overflow tube of the dual flush valve apparatus. In one embodiment the first valve remains in a closed state until fluid in a tank rises to a predetermined level, and the first valve remains in an open position after the fluid in the tank rises above the predetermined level.

Another aspect provides a toilet bowl system. The system comprising a tank coupled to a bowl, a refill mechanism disposed in the tank, a first valve coupled to the refill mechanism, the first valve operates to control flow of fluid into the bowl, a fluid input coupled to a first port of the first valve, and a fluid output coupled to a second port of the first valve and an overflow tube. The level of fluid in the bowl is refilled to a same level for both a full flush and a half flush.

In one embodiment the refill mechanism includes a float-weight cup. In another embodiment the first valve is controlled by a movable rail. In yet another embodiment the float-weight cup is height adjustable. In still another embodiment the float-weight cup opens and closes the first valve. In one embodiment the float-weight cup opens and closes the first valve based on fluid level in the tank. In one embodiment the first valve is controlled by fluid level in the tank. In another embodiment the first valve opens and closes with a float device based on fluid level in a tank. In another embodiment, upon the rail moving to a first vertical position the first valve substantially blocks fluid flow to the bowl, and upon the rail moving to a second vertical position the first valve allows fluid flow to the bowl. In yet another embodiment upon the first valve opening in a first direction, fluid flows from the first port of the first valve to the second port of the first valve and into the overflow tube.

Still another aspect provides a method of filling fluid in a toilet, the method comprising providing a tank coupled to a bowl, providing a refill mechanism including a first valve, providing a second valve, coupling the first valve to a first hose coupled to the second valve, coupling a second hose to a second port of the first valve and an overflow tube, and maintaining a substantially same level of fluid in the for both a full flush and a half flush.

In one embodiment further comprises opening and closing the first valve with a float-weight cup. Another embodiment further comprises opening and closing the first valve with a movable rail. In yet another embodiment the float-weight cup opens and closes the first valve based on fluid level in the tank. In still another embodiment, upon the rail moving to the first vertical position the first valve substantially blocks fluid flow to the bowl, and upon the rail moving to the second vertical position the first valve allows fluid flow to the bowl. In one embodiment the first valve opens and closes with a float device based on fluid level in a tank. In yet another embodiment the first valve remains in a closed state until fluid in a tank rises to a predetermined level, and the first valve remains in an open position after the fluid in the tank rises above the predetermined level.

In another aspect, a method is provided for refilling a dual flush toilet system. The method including providing water to a bowl for a half flush, preventing water from refilling the bowl for a predetermined portion of a full flush, and opening fluid communication with the bowl for a full flush upon the tank water level reaching a predetermined level.

Other aspects and advantages will become apparent from the following detailed description, which, when taken in conjunction with the drawings, illustrate by way of example the principles of the embodiments.

The embodiments, now having been briefly summarized, may be better appreciated by the following detailed description.

BRIEF DESCRIPTION OF THE DRAWINGS

For a fuller understanding of the nature and advantages of the embodiments, as well as a preferred mode of use, reference should be made to the following detailed description read in conjunction with the accompanying drawings, in which.

DETAILED DESCRIPTION OF THE PREFERRED EMBODIMENTS

The various embodiments can now be better understood by turning to the following detailed description wherein illustrated embodiments are described. It is to be expressly understood that the illustrated embodiments are set forth as examples and not by way of limitations on the embodiments as ultimately defined in the claims.

Figure 1:
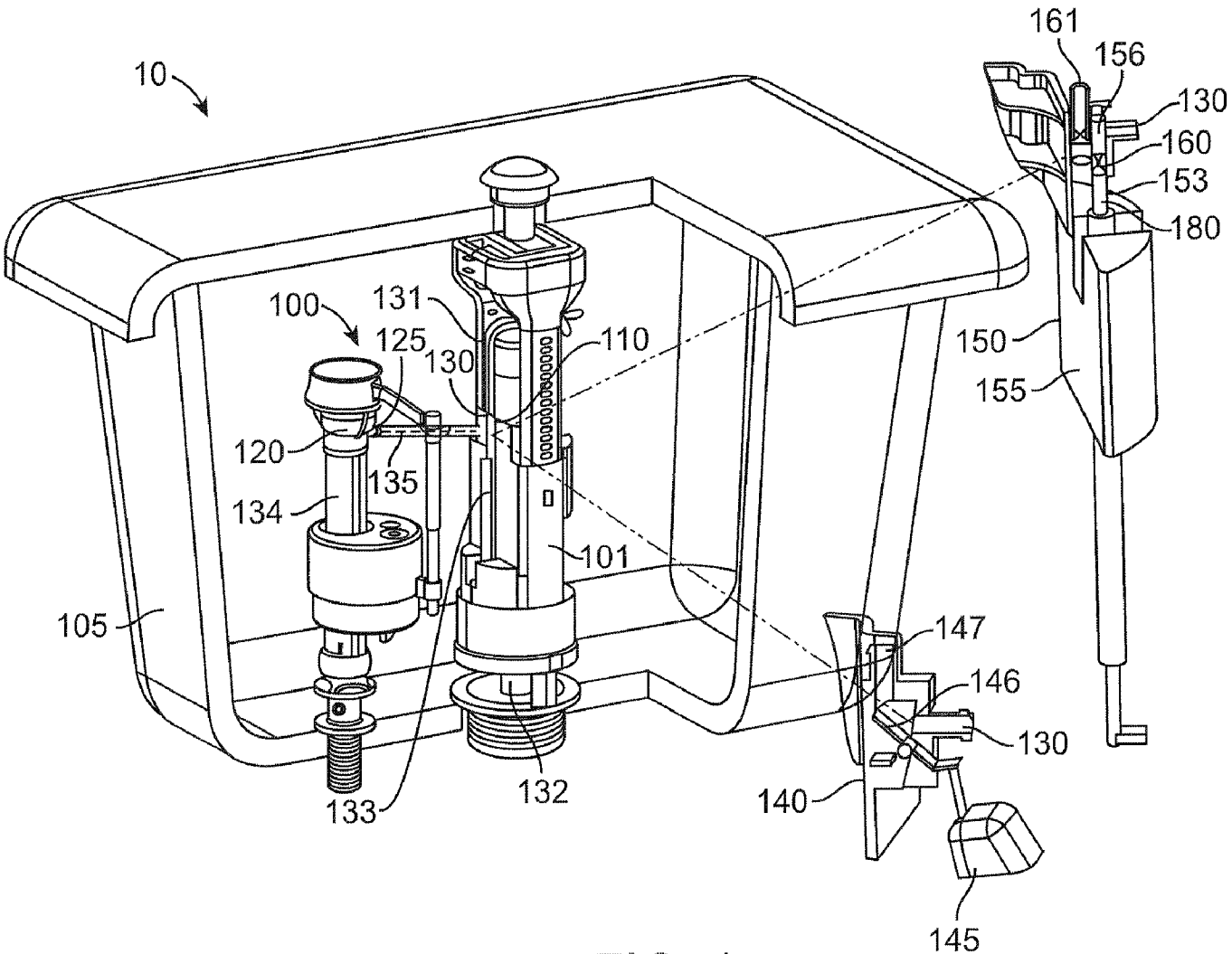
FIG. 1 is an illustration of a partially-cut side view of a toilet tank employing a dual flush valve device in accordance with an embodiment.

FIG. 1 illustrates two embodiments of a refill mechanism to provide the same amount of refill water (volume and level in the bowl) for a toilet bowl when a dual flush valve 100 is used for a half flush and a full flush. In particular, a preferred embodiment of a refill system 10 is configured to provide a sufficient volume of water to refill a toilet bowl during a half flush, and to provide this same volume of water whether a half flush or full flush is selected by the user. The refill system 10 is thus adapted to close, or shut-off, flow of refill water to the toilet bowl for at least a portion of the duration of a full flush.

Since the exact volume to refill a particular toilet bowl varies depending upon the dimensions of the toilet bowl, the refill system 10 may be pre-configured to deliver a particular volume of refill water for the duration of a half-flush.

The first embodiment of a dual flush valve relates to a first valve housing 1 10 where the first valve 150 is a spoon valve type that uses the motion of a rail 153 by fluid level in a tank 105 for a half flush mechanism on a dual flush device to turn on and off the refill water to the toilet bowl. In this embodiment, the valve 150 has two ports, an inlet port 161 and an outlet port 130. The inlet port 161 is connected to one end of a flexible hose 131 which other end is connected to the refill port on a fill valve 101. In this embodiment, the outlet port 130 is connected to one end of another flexible hose 135 whose other end is mounted in a position to direct water to the inside of an overflow tube 134 of the flush valve 120.

In between the input port 161 and the output port 130 is a valve member 180 having a valve close portion 156 and a valve open portion 160. The valve member 180 is controlled by the motion of the rail 133 dictated by the fluid level in the tank 105 of a half flush mechanism to turn on and off the path between the input port 161 and the output port 130. In one embodiment, when the rail 133 of the half flush mechanism is down due to a full flush selected by the user, no water or only small amount of water can go through the valve 150 to refill the bowl as the valve close portion 156 blocks the opening to the input port 30. When the water level in the tank 105 rises to a predetermined level and lifts the half-flush rack 133 up, it opens the valve 150 and lets water enter the bowl to fully refill the bowl by the valve open portion 160 allowing fluid to flow in from the inlet port 161 to the outlet port 130. In the preferred embodiment, the predetermined level at which the rack 133 opens up the valve 150 is set at or adjacent to substantially the same water level at which the water in the tank would descend to upon a half flush. Therefore, for either full or half flushes, refill water for the bowl only flows down to the bowl when the half-flush rail 133 is up. This will supply the same amount of water to refill the bowl in both full and half flushes.

The second embodiment illustrated in FIG. 1 relates to a valve 140 in a valve housing 110 that will rely on water level in the tank to turn on and off water refilled to a toilet bowl. The valve 140 has a rotating valve member 146, which can provide height adjustment for a float cup 145 mounted on the valve member 146. Similar as the first embodiment of the dual flush valve, the valve 140 has an inlet port 147 and an outlet port 130. When water level in the tank 105 is below the float cup 145 of the valve 140, the valve 140 will shut off water from refilling the toilet bowl. The valve 140 will open when the water level in the tank 105 reaches the float cup 145 and raises it up. In one embodiment, the float cup 145 can be adjusted up and down to vary the total amount of water to refill a toilet bowl.

Figure 2B:
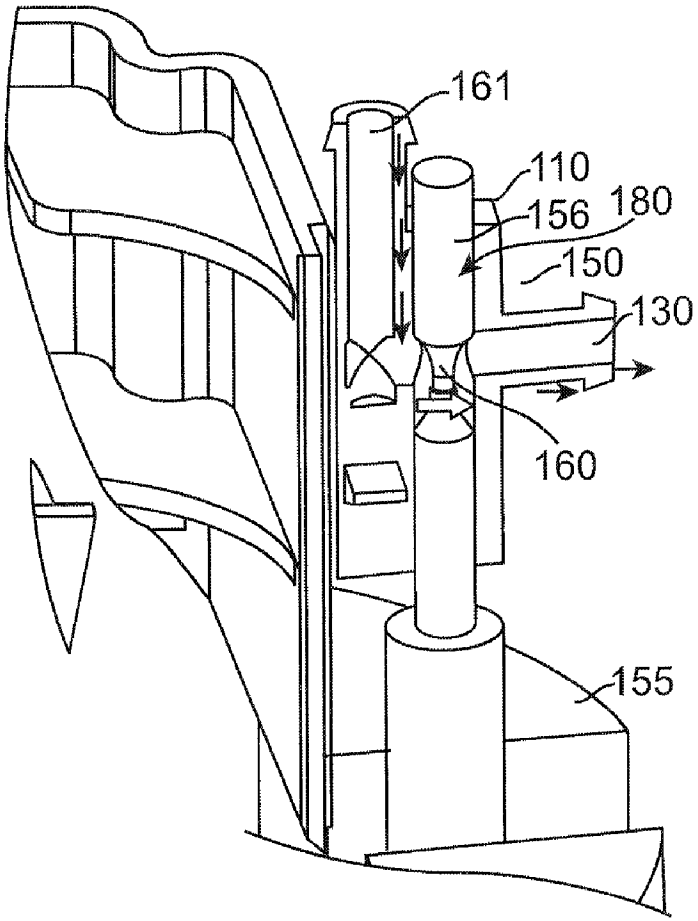
FIG. 2B is an illustration of a isolated view of a first valve in a dual flush valve device shown in an open position according to one embodiment.
Figure 2A:
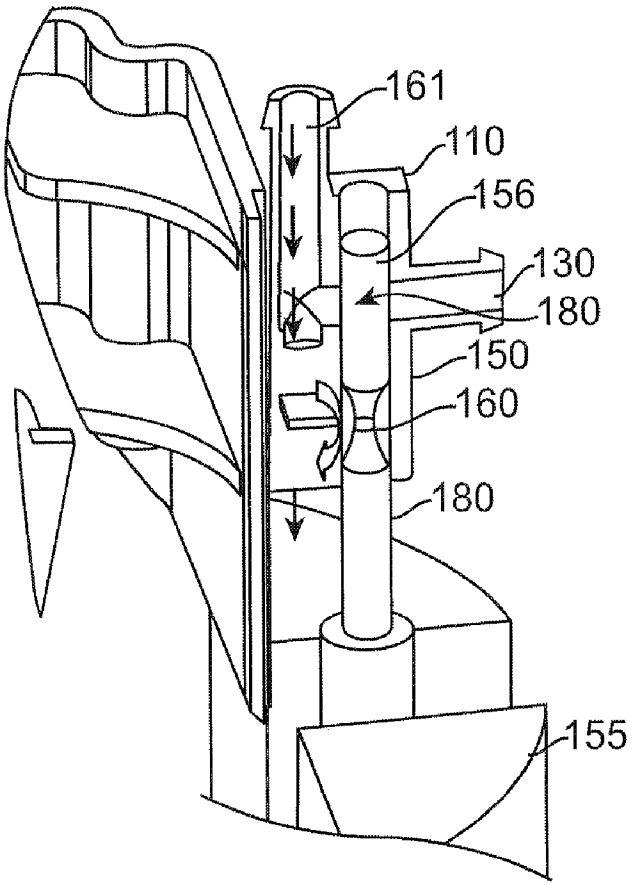
FIG. 2A is an illustration of a isolated view of a first valve in a dual flush valve device shown in a closed position according to one embodiment.

FIG. 2A illustrates the first preferred embodiment of the dual flush valve including valve 150 shown in a closed position with the valve close portion 156 blocking fluid flow to outlet port 130. In this embodiment, the float 155 is in a lower position than necessary to open the valve 150. This is due to the fluid level in the tank being below a predetermined threshold, such as volume in the tank remaining after a half flush. In this embodiment, the circumference of the valve member 180 at the close portion 156 is such that fluid flow to the outlet port 130 is prevented.

FIG. 2B illustrates the first embodiment including the valve 150 shown in an open position with the valve open portion 160 allowing fluid to flow to the outlet port 130. In this embodiment, the float 155 is in a higher position that opens the valve 150. This is due to the fluid level in the tank being at or above a predetermined threshold, such as volume in the tank remaining after a half flush. In this embodiment, the circumference of the valve member 180 at the open portion 156 is such that fluid flows to the outlet port 130.

Figure 3B:
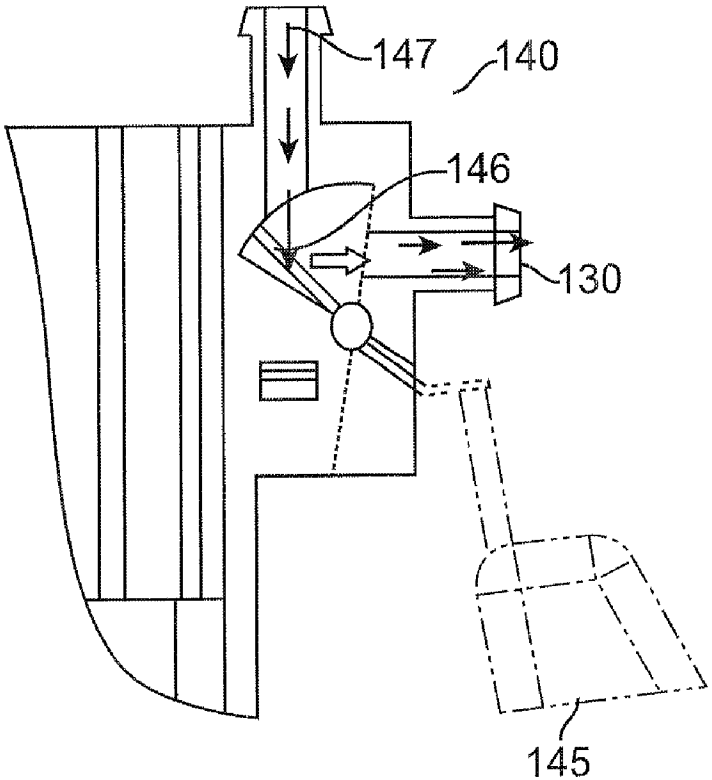
FIG. 3B is an illustration of a isolated view of a first valve in a dual flush valve device shown in an open position according to another embodiment.
Figure 3A:
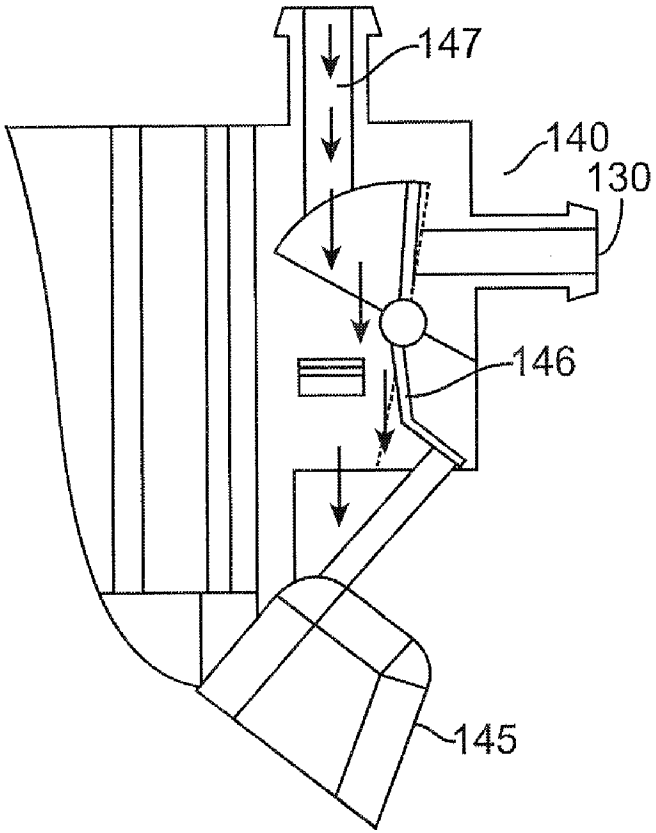
FIG. 3A is an illustration of a isolated view of a first valve in a dual flush valve device shown in a closed position according to another embodiment.

FIG. 3A illustrates the second preferred embodiment of the dual flush valve including the valve 140 shown in a closed position with the valve member 146 blocking fluid flow to the outlet port 130. In this embodiment, the float cup 145 is configured to be in a lower position than necessary to open the valve 140 when the water level in the tank drops to a lower level pursuant to a full flush. This is due to the fluid level in the tank being below a predetermined threshold, such as volume in the tank remaining after a half flush. In this embodiment, the float cup 145 is rotated down such that fluid flow to the outlet port 130 is prevented due to the valve member 146 blocking an opening to the output port.

FIG. 3B illustrates the second embodiment including the valve 140 shown in an open position with the valve member 146 allowing fluid to flow to the outlet port 130. In this embodiment, the float cup 145 is in a higher position that opens the valve 140. This is due to the fluid level in the tank being at or above a predetermined threshold, such as volume in the tank remaining after a half flush. In this embodiment, the float cup 145 is rotated up such that fluid flows to the outlet port 130 due to the valve member 146 rotating away from the opening to the output port.

Figure 4B:
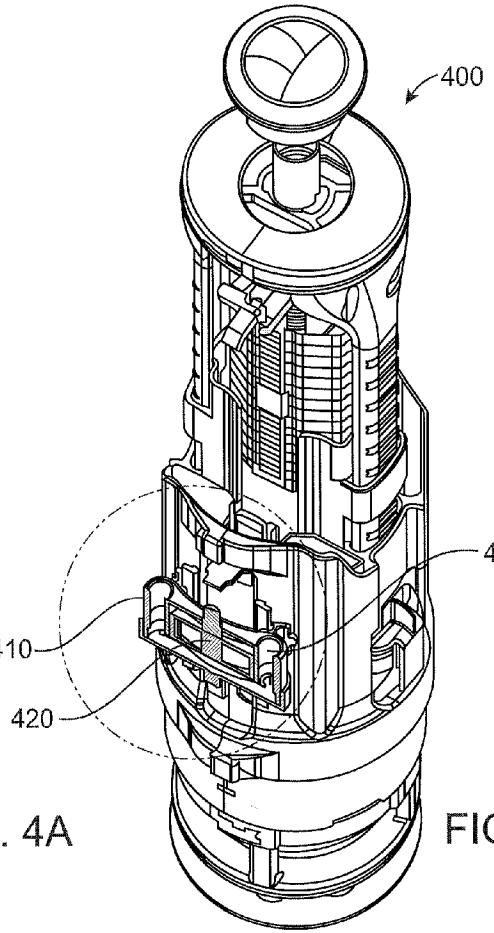
FIG. 4B illustrates an internal view of a first valve in a dual flush valve device according to yet another embodiment.
Figure 4A:
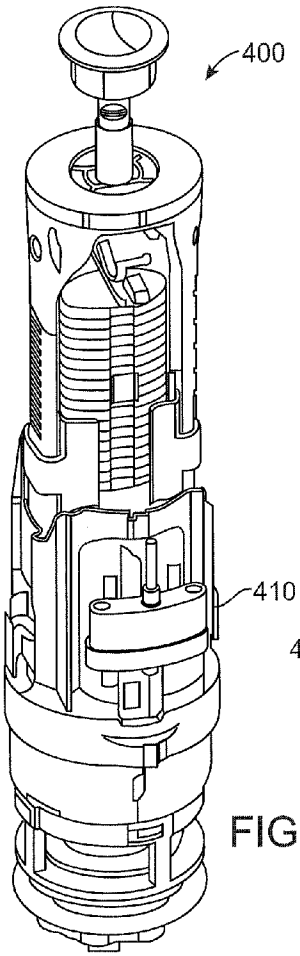
FIG. 4A illustrates a first valve in a dual flush valve device according to yet another embodiment.

FIG. 4A illustrates a third embodiment of a dual flush valve including a flush valve 400 having a valve 410 for refilling a toilet bowl to a same volume and level for full and half flushes. FIG. 4B illustrates an internal view of the valve 410. In this embodiment, the valve 410 includes an inlet port 410, an outlet port 415 and a valve member 420. When the fluid level in the tank 105 is below the valve member 420 as during a full flush, the valve 410 remains in a closed state with the valve member 420 blocking fluid flow from the inlet port 410 to the outlet port 415. In this embodiment, the valve member 420 rises vertically to open the valve 410, and is lowered when the fluid level drops to close the valve 410.

Figure 5A:
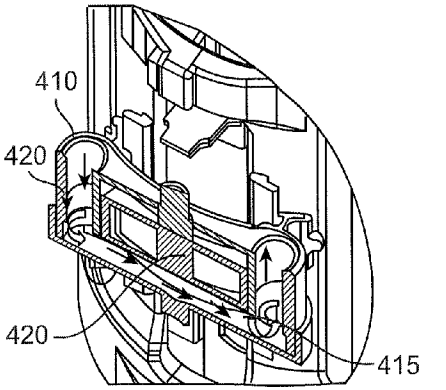
FIG. 5A is an illustration of a isolated view of a first valve in a dual flush valve device shown in an open position according to still another embodiment.

FIG. 5A illustrates the third embodiment of a dual flush valve including valve 410 shown in an open state. As shown, when the fluid level in the tank 105 rises to the level of the valve member 410 and continues to rise, valve member 420 is also raised allowing fluid to flow from the inlet port 410 to the outlet port 415 by creating a flow path. This is due to the fluid level in the tank being above a predetermined threshold, such as volume in the tank remaining after a half flush. In this embodiment, the valve member 420 is forced up from the volume of water in the tank such that fluid flows to the outlet port 415.

Figure 5B:
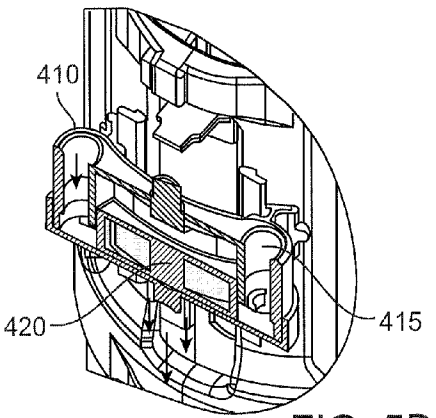
FIG. 5B is an illustration of a isolated view of a first valve in a dual flush valve device shown in a closed position according to still another embodiment.

FIG. 5B illustrates the third embodiment including the valve 410 shown in a closed state. As shown, when the fluid level in tank 105 drops below the level of the valve member 410 as during a full flush, valve member 420 is also lowered, which blocks fluid from flowing from the inlet port 410 to the outlet port 415 by blocking the flow path. This is due to the fluid level in the tank being below a predetermined threshold, such as volume in the tank remaining after a half flush. In this embodiment, the valve member 420 is lowered down such that fluid flow to the outlet port 415 from the inlet port 410 is prevented.

Figure 6:
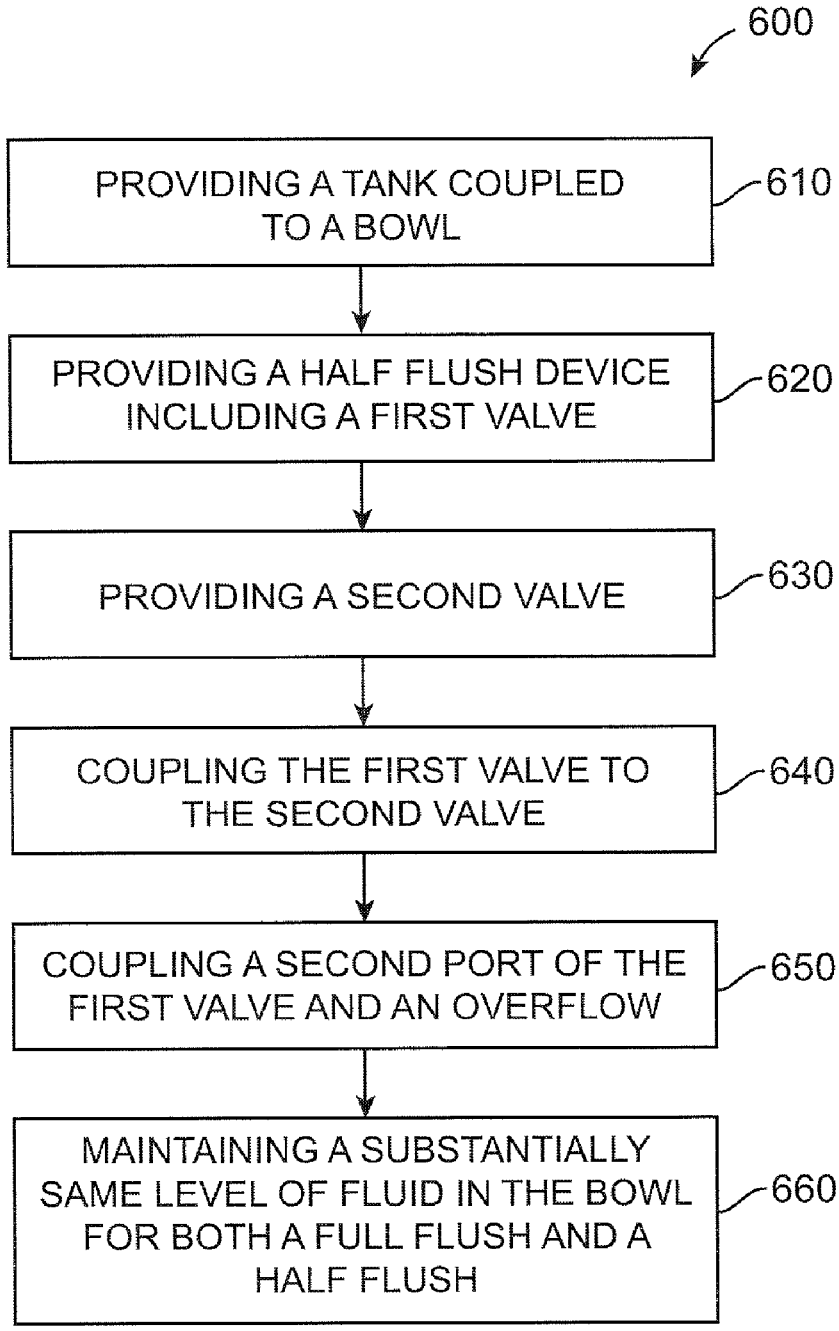
FIG. 6 illustrates a block diagram of a method of refilling a bowl for a full and half flush.

FIG. 6 illustrates a block diagram of a preferred method 600 of refilling a toilet bowl for a dual flush toilet. In block 610 a tank connected to a bowl, whether one or more pieces, is provided. In block 620, a refill mechanism is provided including a first valve including an inlet port and an outlet port. In block 630 a second valve is provided. In block 640, the first and second valves are connected together. In block 650 the second port of the first valve is connected to an overflow tube. In block 660, fluid level in a toilet tank is maintained to be substantially the same level for both a full flush and a half flush.

In one embodiment, method 600 further includes opening and closing the first valve with a float-weight cup. The float-weight cup opens and closes the first valve based on fluid level in the tank. Another embodiment includes opening and closing the first valve with a movable rail. Upon the rail moving to the first vertical position the first valve substantially blocks fluid flow to the bowl, and upon the rail moving to the second vertical position the first valve allows fluid flow to the bowl. In one embodiment, upon the first valve opening in a first direction, fluid flows from the first port of the first valve to the second port of the first valve and into the overflow tube. In still another embodiment, the first valve opens and closes with a float device based on fluid level in a tank. The first valve remains in a closed state until fluid in a tank rises to a predetermined level, and the first valve remains in an open position after the fluid in the tank rises above the predetermined level.

Figure 7:
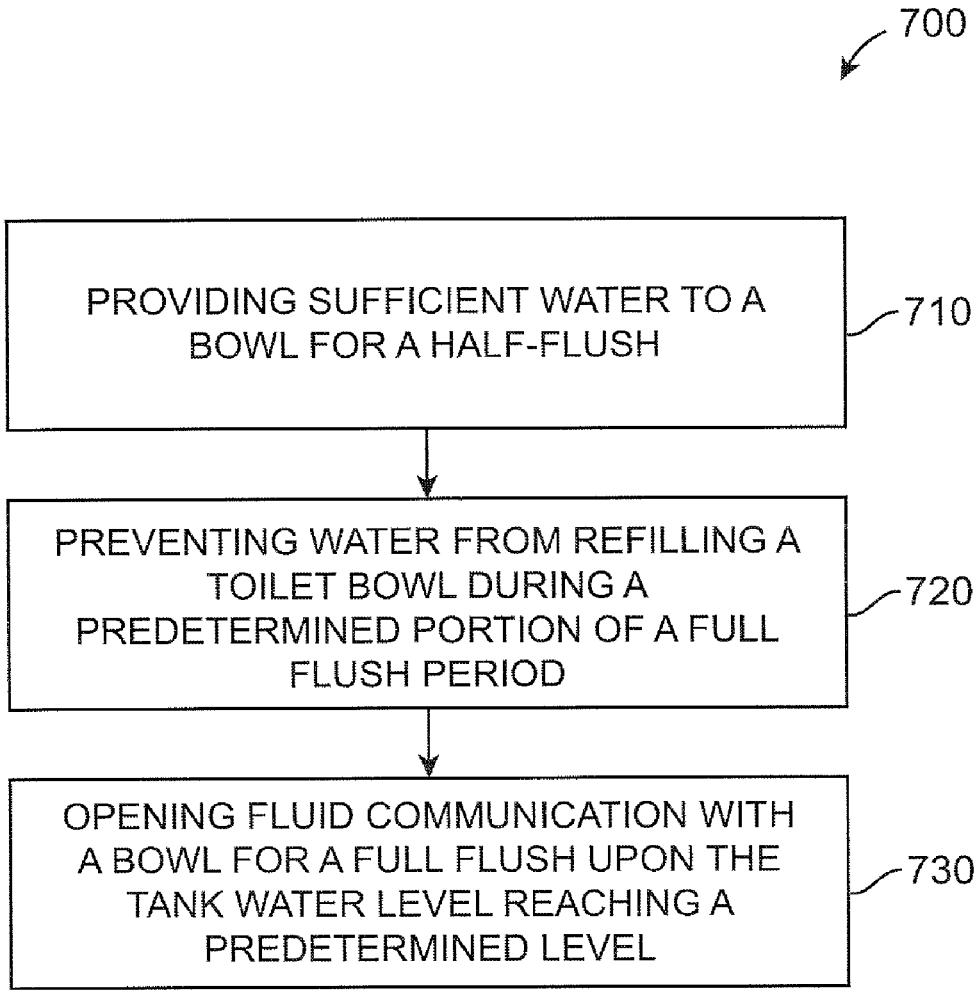
FIG. 7 illustrates a block diagram of another method of refilling a toilet bowl of a dual flush toilet.

FIG. 7 is a block diagram of a preferred method 700 of refilling a toilet bowl of a dual flush toilet. In block 710, the refill system is configured to provide a sufficient volume of water to fill a toilet bowl during a half flush. In one embodiment, the refill system uses approximately a half a tank or half the volume of water used during a full flush to flush the bowl. While the tank is then filling back to a volume necessary for a full flush, the bowl is refilled during this time.

In block 720, the refill system is prevented from refilling the toilet bowl for at least a portion of the duration of a full flush. In this embodiment, a passageway is provided to supply refill water to the toilet bowl. The passageway is blocked when water in toilet tank is below a predetermined level, namely, the level at which water would descend to in the toilet tank when a half flush is engaged by user. In one embodiment, the predetermined level is half of a tank. It should be noted that the level can be adjusted to a user's preference.

In block 730, fluid communication is opened between a source of refill water and the toilet bowl when water in the toilet tank reaches a predetermined level, namely, at or adjacent to the lowest level of water reached in the tank when a half flush is engaged by user. In one embodiment a sensor is used with a valve. Upon sensing the water level is at the predetermined level, the valve is then opened to allow the fluid communication.

Alternatively, the method 700 comprises opening fluid communication between a source of refill water and the toilet bowl when a half flush is engaged, and delaying or blocking the opening of fluid communication between the source of refill water and the toilet bowl for a limited portion of the duration of a full flush.

Advantageously, the embodiments provide a device, system and method of maintaining a refill level of fluid in a toilet bowl for both a full flush and a half flush. In one embodiment, a valve remains closed until either fluid in the tank reaches a predetermined level, and then allows the flow of fluid into an overflow tube, or a valve remains closed for a predetermined time period allowing fluid to reach a predetermined level based on input flow rate into the tank.

Many alterations and modifications may be made by those having ordinary skill in the art without departing from the spirit and scope of the embodiments. Therefore, it must be understood that the illustrated embodiments have been set forth only for the purposes of examples and that they should not be taken as limiting the embodiments as defined by the following claims. For example, notwithstanding the fact that the elements of a claim are set forth below in a certain combination, it must be expressly understood that the embodiments include other combinations of fewer, more or different elements, which are disclosed above even when not initially claimed in such combinations.

The words used in this specification to describe the various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the embodiments.

What is claimed is:

1. A dual flush valve apparatus for refilling fluid in a toilet bowl, comprising:

a flush valve configured to refill the toilet bowl with a substantially same volume of refill fluid for both a full flush and a half flush;

a refill valve mounted on the flush valve, wherein the refill valve operates to direct flow either into a toilet bowl, or into a toilet tank, wherein the refill valve comprises:

a fluid input coupled to a first port of the refill valve;

a fluid output coupled to a second port of the refill valve, and a valve member that moves up and down along the flush valve such that: (i) when the valve member is positioned above the fluid level in the toilet tank, flow between the fluid input and the fluid output is cut off and flow is directed into the toilet tank, and (ii) when the valve member is positioned below the fluid level in the toilet tank, flow between the fluid input and the fluid output is permitted and flow is directed into the toilet bowl, and wherein the level of fluid in the bowl is refilled to a same level for both a full flush and a half flush.

2. The dual flush valve apparatus of claim 1, wherein the refill valve is controlled by fluid level in a tank.

3. The dual flush valve apparatus of claim 1, wherein the valve member remains in a closed state until fluid in a tank rises to a predetermined level, and the valve member remains in an open position after the fluid in the tank rises above the predetermined level.

4. A toilet bowl system, comprising:

a tank coupled to a bowl, a flush valve disposed in the tank, wherein the flush valve is configured to refill the bowl with a substantially same volume of refill fluid for both a full flush and a half flush;

a refill valve mounted on the flush valve, the refill valve operates to direct flow either into the bowl, or into a toilet tank, wherein the refill valve comprises:

a fluid input coupled to a first port of the refill valve;

a fluid output coupled to a second port of the refill valve and an overflow tube, and a valve member that moves up and down along the flush valve such that: (i) when the valve member is positioned above the fluid level in the toilet tank, flow between the fluid input and the fluid output is cut off and flow is directed into the toilet tank, and (ii) when the valve member is positioned below the fluid level in the toilet tank, flow between the fluid input and the fluid output is permitted and flow is directed into the toilet bowl, and wherein the level of fluid in the bowl is refilled to a same level for both a full flush and a half flush.

5. The system of claim 4, wherein the refill valve is controlled by fluid level in the tank.

6. The system of claim 4, wherein upon the refill valve opening in a first direction, fluid flows from the first port of the refill valve to the second port of the refill valve and into the overflow tube.

* * * * *